US006488393B1

(12) United States Patent
Burnham

(10) Patent No.: US 6,488,393 B1
(45) Date of Patent: Dec. 3, 2002

(54) DISPLAY LAMP AND METHOD

(76) Inventor: David J. Burnham, 800 Custer, Apt. 3C, Evanston, IL (US) 60202

( * ) Notice: Subject to any disclaimer, the term of this patent is extended or adjusted under 35 U.S.C. 154(b) by 0 days.

(21) Appl. No.: 09/693,506

(22) Filed: Oct. 23, 2000

(51) Int. Cl.[7] ..... F21V 5/00; F21V 9/12

(52) U.S. Cl. ..... 362/318; 362/96; 362/806; 362/40; 362/101; 362/811

(58) Field of Search ..... 362/96, 806, 40, 362/318, 101, 811

(56) References Cited

U.S. PATENT DOCUMENTS

| | | | | |
|---|---|---|---|---|
| 344,373 | A | | 6/1886 | Harris |
| 1,856,098 | A | | 5/1932 | Green |
| 2,721,256 | A | | 10/1955 | Duhon |
| 2,818,770 | A | | 1/1958 | Cilurzo |
| 3,162,367 | A | | 12/1964 | Nowack |
| 3,174,688 | A | | 3/1965 | Chatten |
| 3,185,829 | A | | 5/1965 | Rau |
| 3,401,596 | A | | 9/1968 | Hirsch |
| 3,762,082 | A | | 10/1973 | Mincy |
| 4,034,493 | A | | 7/1977 | Ball |
| 4,426,021 | A | * | 1/1984 | Rosenthal ..... 222/129.1 |
| 4,975,811 | A | | 12/1990 | Fraser et al. |
| 5,272,604 | A | * | 12/1993 | Lin ..... 362/96 |
| 5,683,174 | A | | 11/1997 | Lena, Jr. |
| 5,758,824 | A | | 6/1998 | Kuykendal et al. |
| 5,823,431 | A | | 10/1998 | Pierce |
| 5,938,318 | A | | 8/1999 | Mattsen |
| 5,967,371 | A | * | 10/1999 | Stephen ..... 222/108 |
| 6,203,163 | B1 | * | 3/2001 | Conway, Jr. ..... 362/96 |
| 6,210,015 | B1 | * | 4/2001 | Ross ..... 362/101 |

* cited by examiner

*Primary Examiner*—Thomas M. Sember
*Assistant Examiner*—Jacob Y. Choi
(74) *Attorney, Agent, or Firm*—Seyfarth Shaw

(57) ABSTRACT

A display lamp includes an electric light bulb disposed within a cylinder supported in a substantially vertical orientation. A light-transmitting container of water or other light-transmitting liquid is supported on the top of the cylinder. A dispenser of liquid is disposed above the container for dropping droplets of liquid onto the surface of the liquid in the container for disturbing it. The light shines through the vessel and the liquid and its disturbed surface and onto an associated display surface, such as an adjacent wall or ceiling, for producing thereon a visual wave pattern which moves in accordance with the disturbance of the liquid surface.

20 Claims, 2 Drawing Sheets

DISPLAY LAMP AND METHOD

BACKGROUND

This application relates generally to decorative displays and, in particular, to displays incorporating light patterns.

It is known to provide decorative light displays by directing a light beam from a source to or through reflective and/or refractive elements. Some such systems have achieved a moving display by moving either the light beam or the reflective or refractive elements. It is also known to provide a decorative display by shining a light beam through a stationery body of liquid, which may or may not have moving elements, such as air bubbles, therein. All of these prior types of displays, however, are designed so that it is the look of the display apparatus itself, and not the resulting light pattern, that is of interest.

It is also known to provide displays involving shadow projection devices, wherein light rays from a source are projected through apertures or the like to project decorative shadows.

Another type of display has involved directing a light beam through a moving body of liquid to achieve a decorative moving light pattern. One such arrangement is disclosed in U.S. Pat. No. 5,683,174, which directs light through a liquid-containing cell, the cell being moved by a tilting mechanism. But this device is fairly complicated, requiring an electromechanical mechanism for moving the liquid cell.

SUMMARY

There are disclosed herein a display lamp and method which avoid the disadvantages of prior display devices and methods while affording additional structural and operating advantages.

An important aspect is the provision of a display apparatus which generates a visual wave pattern which moves in accordance with the disturbance of the surface of a body of liquid.

In connection with the foregoing aspect, another aspect is the provision of a display apparatus of the type set forth, which directs light through the liquid and its disturbed surface and onto a display surface.

Another feature is the provision of an apparatus of the type set forth which has no moving parts.

Another aspect is the provision of an apparatus of the type set forth which is of relatively simple and economical construction.

A still further aspect is the provision of a display method which involves directing light through the disturbed surface of a body of liquid.

Certain ones of these and other aspects may be achieved by providing a display apparatus comprising a light source, a vessel containing a supply of a light-transmitting liquid having a surface, a disturbance system for disturbing the liquid surface without disturbing the vessel, and a directing structure directing light from the source through the liquid and a liquid surface for producing on an adjacent display surface a visual wave pattern which moves in accordance with the disturbance of the liquid surface.

Others of these aspects may be achieved by providing a display apparatus of the type set forth, wherein the liquid surface is disturbed by dispensing thereonto disturbing bodies.

Still other aspects may be achieved by providing a method of producing a moving visual wave pattern on a display surface, comprising providing a vessel containing a supply of a light-transmitting liquid having a liquid surface, disturbing the liquid surface without disturbing the vessel and, while the liquid surface is being disturbed, directing a light beam through the liquid and the liquid surface and onto the display surface.

BRIEF DESCRIPTION OF THE DRAWINGS

For the purpose of facilitating an understanding of the subject matter sought to be protected, there is illustrated in the accompanying drawings an embodiment thereof, from an inspection of which, when considered in connection with the following description, the subject matter sought to be protected, its construction and operation, and many of its advantages should be readily understood and appreciated.

DETAILED DESCRIPTION

Figure 1:
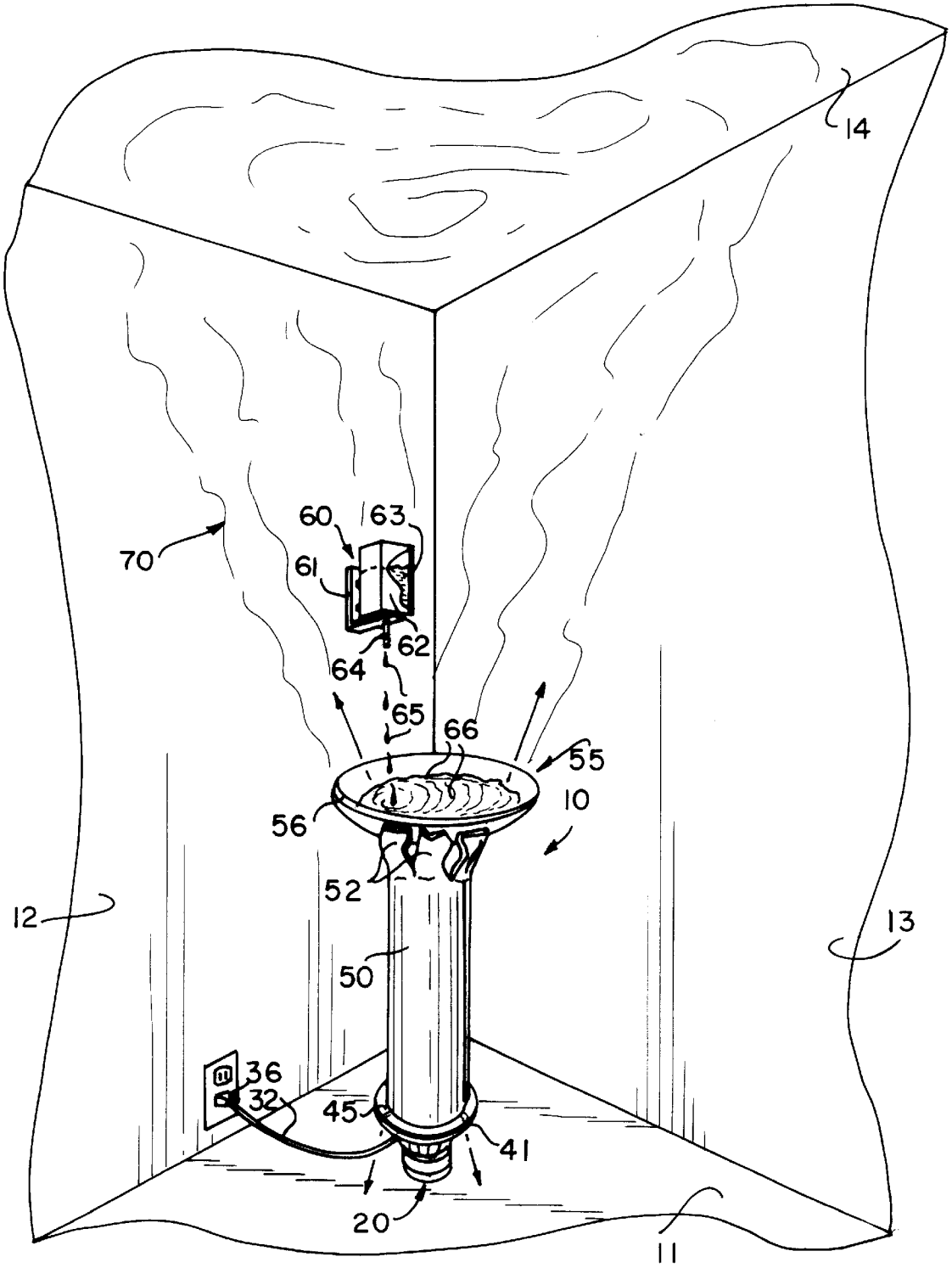
FIG. 1 is a perspective view of a display system, illustrating the wave pattern generated thereby projected onto display surfaces.
Figure 2:
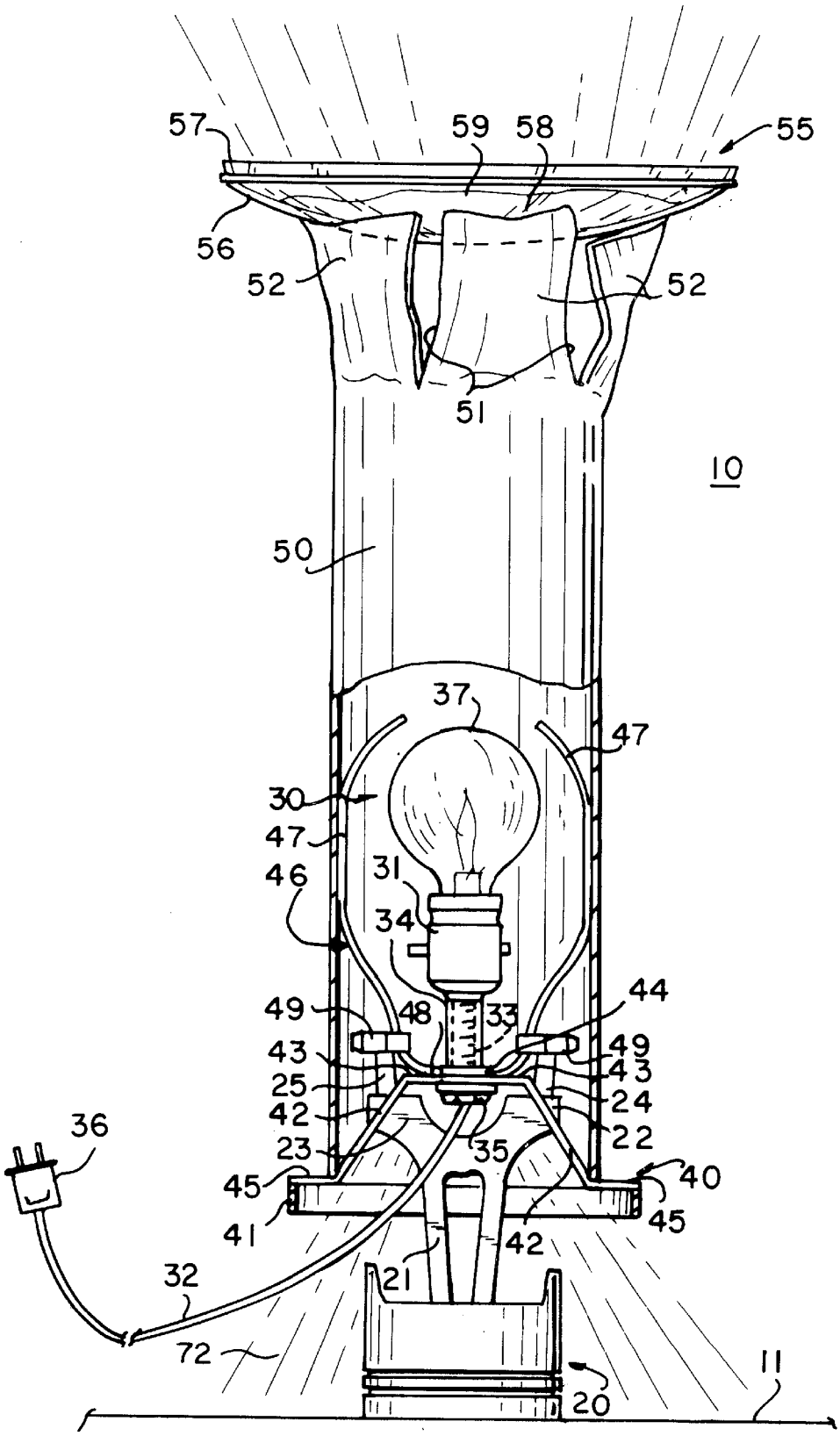
FIG. 2 is an enlarged, side elevational view of a display lamp of FIG. 1.

Referring to FIGS. 1 and 2, there is illustrated a display system including a display lamp, generally designated by the numeral 10, disposed on the floor 11 in a corner of a room having walls 12 and 13 and a ceiling 14, which form display surfaces. The lamp 10 has a base 20 which, in the illustrated embodiment, is in the form of an inverted piston of an automotive internal combustion engine, and has an upstanding stem 21 provided at its upper end with a pair of laterally outwardly projecting arms 22 and 23, respectively having upstanding posts 24 and 25 thereon.

Mounted on the base 20 is a light source assembly 30, which may include a standard AC lamp socket 31 having a power cord 32 extending through a hollow, externally threaded rod 33 threaded into the bottom of the socket 31. The rod 33 extends coaxially through a cylindrical brass collar 34 and has its lower end threaded by engaged with a retaining nut 35. The distal end of the power cord 32 is provided with a standard plug 36 for plugging into a standard wall socket of a 110-VAC household supply.

The lamp 10 also includes a support 40, which may be in the form of a standard lamp shade support, having an annular ring 41 with a plurality (two shown) of arms 42 connected thereto and extending upwardly therefrom. The arms 42 may be in the form of metal straps or bands, which are equiangularly spaced apart around the ring 41, the arms 42 respectively having inturned shoulders 43 at their upper ends joined by an annular hub 44, the arms 42 being respectively provided at their lower ends with outturned feet 45 which are secured, as by welding or the like, to the ring 41. Disposed on the support 40 is a bulb protector 46, which includes elongated curved arms 47 having inturned lower ends joined by an annular base 48.

In assembly, the base 48 of the bulb protector 46 is seated on the shoulders 43 of the support arms 42, with the hub 44 received through the opening in the bulb protector base 48. The collar 34 is fitted over the rod 33, and the cord 32 and the distal end of the rod 33 are then fitted downwardly through the annular hub 44 and the base 48 until the collar 34 is seated on the hub 44. Then the nut 35 is fitted over the plug 36 and cord 32 and threaded onto the lower end of the rod 33 to clamp the assembled parts firmly together. The assembled light source assembly 30 and a support 40 are mounted onto the base 20 by means of clamps 49, which respectively clamp the bulb protector arms 47 to the base posts 24 and 25.

While, in the illustrated embodiment, the base 20 is in the form of an automotive piston, and the support 40 is in the form of a lamp shade support, it will be appreciated that any other type of base could be utilized, as long as it has a sufficient combination of weight and footprint diameter to afford stability, and any desired mechanism could be utilized to mount the light source assembly 30 on the base.

The lamp 10 also includes an elongated light-directing cylinder 50, which may be formed of metal or any other material, and has a diameter such that it can be fitted down over the arms 47 of the bulb protector 46 and have its lower end seated on the feet 45 of the support 40. Thus, the arms 47 protect the bulb 37 from contact with the cylinder 50 and also maintain the cylinder 50 in an upstanding, substantially vertical orientation spaced above the floor to permit air flow into the lower end of the cylinder 50. The cylinder 50 may have circumferentially spaced slots 51 extending longitudinally into its upper end. The slots 51 provide vent openings and for dividing the upper end into a plurality of fingers 52, which may have their upper ends flared outwardly to provide an enlarged support surface for supporting thereon a lens assembly 55. More specifically, the lense assembly 55 includes a vessel 56, such as a shallow bowl or dish, formed of a light-transmitting material, such as glass, plastic, or the like. Preferably, the vessel 56 is transparent to visible light, but may also be translucent. The vessel 57 has an open top 57 and contains therein a body of liquid 58 having an exposed surface 59. The liquid 58 is also light-transmitting, preferably being substantially transparent to visible light. The liquid 58 may be water, or some other light-transmitting liquid.

The display system also includes a disturbance system which includes a dispenser 60 for disturbing the surface 59 of the liquid 58. In the illustrated embodiment the dispenser 60 includes a support bracket 61, which may be an angle bracket mounted on one of the walls 12 and 13, and supports a container 62, which contains a supply of liquid 63. The liquid 63 may be the same as the liquid 58 in the vessel 56, or may be some other liquid. Projecting downwardly from the container 62 is a wick 64 of a material of such that the liquid 63 will wick therealong. The bracket 61 is so positioned that droplets 65 of the liquid 63, which form at and fall from the end of the wick 64, will fall into the vessel 56 and onto the surface 59 of the liquid 58, disturbing the surface by forming ripples or waves 66 therein. (FIG. 2).

In operation, light from the bulb 37 is directed upwardly by the cylinder 50 onto the bottom of the vessel 56, the light passing through the vessel 56 and the body of water 58 and the surface 59 thereof to form a diverging display pattern 70, which is projected onto the walls 12 and 13 and the ceiling 14. The display pattern 70 has waves or ripples 71 therein which move in accordance with the movement of the ripples or waves 66 on the surface of the liquid 58. Thus, the display pattern 70 is continually in motion, as long as the disturbing droplets 65 continue to drop onto the liquid surface 59. Because the bottom of the cylinder 50 is open, a cone of light is also emitted therefrom onto the floor 11, as at 72.

While, in the illustrated embodiment, the dispenser 60 is mounted on a wall above the vessel 56, it will be appreciated that it could also be mounted on the ceiling 14 or, alternatively, disposed in a recess (not shown) in the ceiling 14 so that it would not obstruct the display pattern 70. Also, while a simple wick arrangement is illustrated for the dispenser 60, it will be appreciated that other techniques could be utilized for forming droplets of liquid and dispensing them onto the liquid surface 59.

While, in the illustrated embodiment, an AC electric light bulb 37 is used as the light source, it will be appreciated that other types of light sources could be used, and electrically powered sources could be battery-powered rather than AC-powered.

From the foregoing, it can be seen that there has been provided an improved decorative display system which is of simple and economical construction and includes an apparatus having no moving parts, but which can generate a moving display pattern for projection onto a display surface.

The matter set forth in the foregoing description and accompanying drawings is offered by way of illustration only and not as a limitation. While particular embodiments have been shown and/or described, it will be obvious to those skilled in the art that changes and modifications may be made without departing from the broader aspects of applicants' contribution. The actual scope of the protection sought is intended to be defined in the following claims, when viewed in their proper perspective based on the prior art.

I claim:

1. A display apparatus comprising:

a light source, a vessel containing a supply of a light-transmitting liquid having an upper surface at a predetermined level, a disturbance system for disturbing the liquid surface from thereabove without disturbing the vessel and without significantly changing the predetermined level, and a directing structure directing light from the source through the liquid and then through the liquid surface and then onto a display surface spaced from the vessel for projecting onto the display surface a visual wave pattern which moves in accordance with disturbance of the liquid surface.

2. The apparatus of claim 1, wherein the light source is an AC-powered electric bulb.

3. The apparatus of claim 1, wherein the vessel is formed of a light-transmitting material, the directing structure directing light from the source through the vessel.

4. The apparatus of claim 3, wherein the vessel is transparent.

5. The apparatus of claim 3, wherein the vessel has an open top, the light source being disposed beneath the vessel.

6. The apparatus of claim 5, wherein the directing structure is a cylinder.

7. The apparatus of claim 6, wherein the vessel is supported on the cylinder.

8. The apparatus of claim 1, wherein the liquid is water.

9. A display apparatus comprising:

a light source, a vessel containing a supply of a light-transmitting liquid having an upper surface at a predetermined level, a dispenser for dispensing disturbing bodies onto the liquid surface from thereabove for disturbing the liquid surface without disturbing the vessel and without significantly changing the predetermined level, and a directing structure directing light from the source through the liquid and then through the liquid surface for projecting onto a display surface spaced from the vessel a visual wave pattern which moves in accordance with disturbance of the liquid surface.

10. The apparatus of claim 9, wherein the disturbing bodies are droplets of liquid.

11. The apparatus of claim 10, wherein the droplets of liquid are the same liquid as the supply of liquid in the vessel.

12. The apparatus of claim 9, and further comprising apparatus for supporting the dispenser above the liquid surface for dropping the disturbing bodies onto the liquid surface.

13. The apparatus of claim 9, wherein the vessel is formed of a light-transmitting material, the directing structure directing the light through the vessel.

14. A method of producing a moving visual wave pattern on a display surface comprising:

providing at a location spaced from the display surface a vessel containing a supply of a light-transmitting liquid having an upper liquid surface at a predetermined level, disturbing the liquid surface without disturbing the vessel, and without significantly changing the predetermined level, and while the liquid surface is being disturbed directing a light beam through the liquid and then through the liquid surface for projecting onto the display surface for projecting onto the display surface a visual wave pattern which moves in accordance with the disturbance of the liquid surface.

15. The method of claim 14, and further comprising containing the liquid in a light-transmitting vessel, the directing step including directing the light through the vessel.

16. The method of claim 14, wherein the disturbing includes dispensing disturbing bodies onto the liquid surface.

17. The method of claim 16, wherein the disturbing includes dispensing onto the liquid surface droplets of the same liquid.

18. The method of claim 17, wherein the droplets are dropped onto the surface of the liquid from thereabove.

19. The display apparatus of claim 1, wherein the directing structure is opaque.

20. The display apparatus of claim 9, wherein the directing structure is opaque.

* * * * *

UNITED STATES PATENT AND TRADEMARK OFFICE

CERTIFICATE OF CORRECTION

PATENT NO. : 6,488,393 B1
DATED : December 3, 2002
INVENTOR(S) : Burnham

It is certified that error appears in the above-identified patent and that said Letters Patent is hereby corrected as shown below:

Title page,
Item [56], References Cited, U.S. PATENT DOCUMENTS, add:

| | | | | |
|---|---|---|---|---|
| -- | 2,117,337 | * | 11/1937 | Stein |
| | 4,388,678 | * | 6/1983 | Turner |
| | 5,555,658 | * | 9/1996 | Yu |
| | 5,967,639 | * | 10/1999 | Shih --. |

Signed and Sealed this

Twenty-sixth Day of August, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,488,393 B1
DATED : December 3, 2002
INVENTOR(S) : Burnham

It is certified that error appears in the above-identified patent and that said Letters Patent is hereby corrected as shown below:

Title page,
Item [56], References Cited, U.S. PATENT DOCUMENTS,
"2,117,337 11/1937 Stein" should be -- 2,177,337 10/1939 Stein --.

Signed and Sealed this

Twenty-seventh Day of January, 2004

JON W. DUDAS
*Acting Director of the United States Patent and Trademark Office*